United States Patent [19]

Morgan

[11] 3,949,431

[45] Apr. 13, 1976

[54] LATRINES

[75] Inventor: Peter Roger Morgan, Salisbury, Rhodesia

[73] Assignee: Technical Innovation Company for Commerce and Industry (TICCI), Luxembourg, Luxemburg

[22] Filed: Nov. 7, 1974

[21] Appl. No.: 521,815

[30] Foreign Application Priority Data

Nov. 9, 1973 Rhodesia ..... 433/73

[52] U.S. Cl. ..... 4/85

[51] Int. Cl.[2] ..... E03D 11/10

[58] Field of Search ..... 4/76, 84, 85, 93, 28, 107, 4/249

[56] References Cited

UNITED STATES PATENTS

| | | | |
|---|---|---|---|
| 1,005,075 | 10/1911 | Rosenstock | 4/85 X |
| 3,781,920 | 1/1974 | Browne et al. | 4/84 X |
| 3,790,967 | 2/1974 | Pignato | 4/28 |
| 3,798,681 | 3/1974 | Johansen | 4/84 X |

*Primary Examiner*—Richard E. Aegerter
*Assistant Examiner*—Stuart S. Levy
*Attorney, Agent, or Firm*—Ladas, Parry, Von Gehr, Goldsmith & Deschamps

[57] ABSTRACT

A pit-type latrine with a capability of sealing the escape of odors and the ingress of insects, including a chute and a tippable pan at the lower zone of the chute adapted to contain a quantity of water.

6 Claims, 5 Drawing Figures

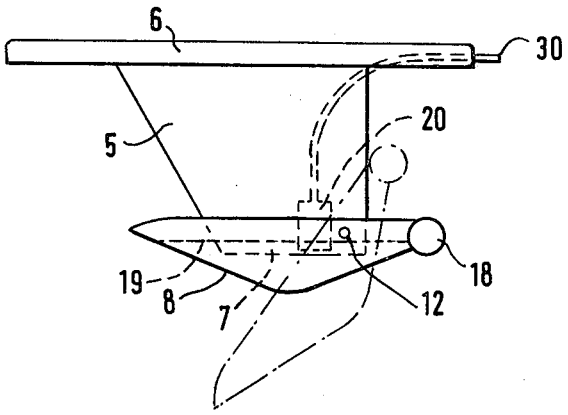
FIG. I.
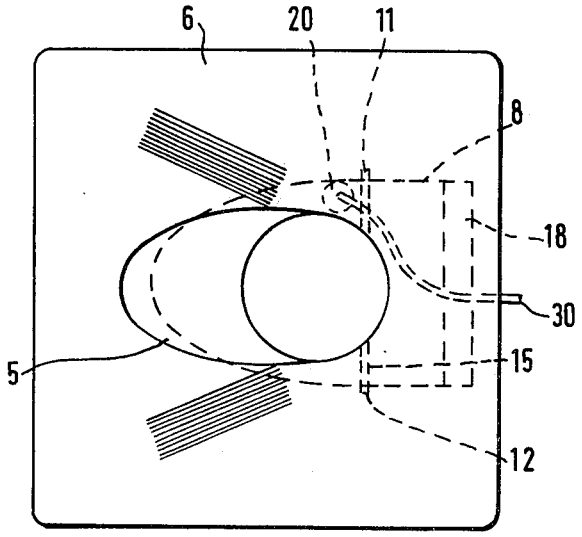
FIG. II.

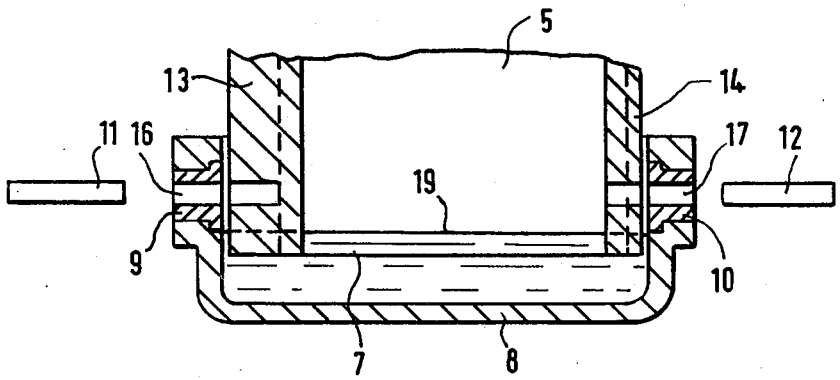
FIG. III.
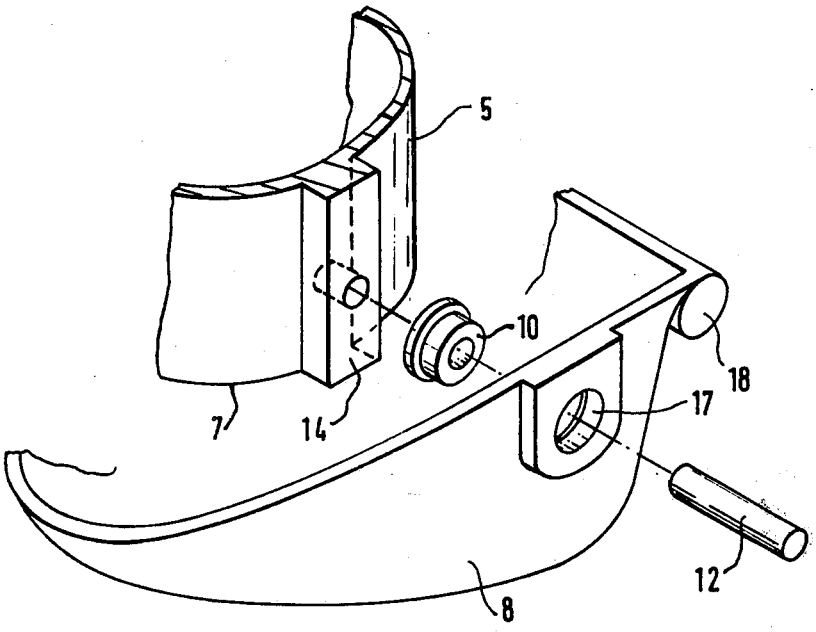
FIG. IV.

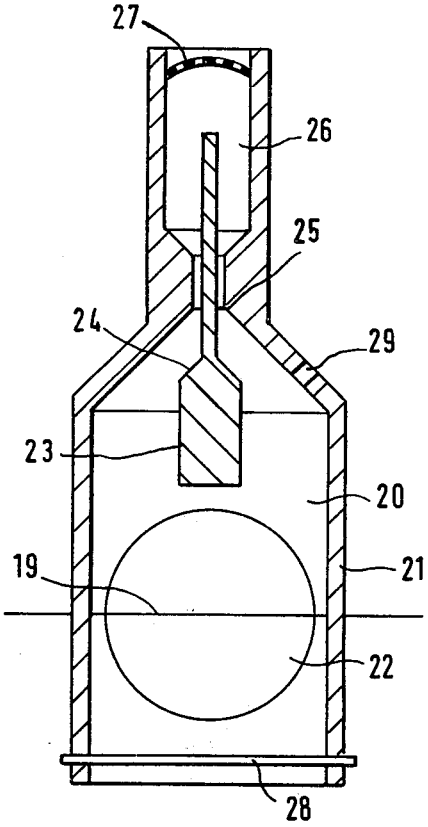
FIG. V.

LATRINES

This invention relates to lavatories and in particular to improvements in pit-type latrines.

It is a long standing problem with the pit-type or open latrine, that offensive odours escape and that insects such as the house fly have ready access where they breed and pick up offensive matter and various bacterial infections which they then spread to food stuffs and the like. Amongst the many common diseases resulting from inadequate sanitation are cholera, typhoid and paratyphoid fevers, dysenteries and infant diarrhoeas. It is well known that populations rid of these diseases by proper sanitation have a greater sense of well being and are more productive.

In the context of the poorer and possibly less developed countries, improvements in latrines is considered to be of paramount importance by world health authorities. There is however a very human tendency to avoid the pit-type latrine even though it may be that which is known as the 'aqua privy', because of offensive conditions and infestation by flies and the like.

Avoidance of the latrine and use of the surrounding area, be it desert, bush or even cultivated lands as the general latrine for a village or compound may be on an extensive scale and this will lead to decidedly insanitary conditions with high risk of infection.

It is a prime purpose of this invention to provide a sealing device which may be cheaply produced and installed. Additionally it should be relatively cheap to produce; uses very little water and is not readily blocked.

It may be adapted to fit to existing deep pit-type latrines and even to the established aqua privy.

Preferably however it is designed as a new piece of equipment to be fitted to existing or new pit-type latrines.

The device of the invention is expected to eliminate or greatly to reduce the disadvantages of existing latrines as in common use in the world.

According to the invention a device adapted to seal a lavatory arrangement from escape of odours and ingress of insects includes a chute associated with the 'seat' and directed substantially downward; a tippable pan associated with the lower zone of the chute and arranged and adapted to contain a quantity of water when in the normal or substantially horizontal position but to tip towards the vertical position upon addition of further material to the pan and to return to the substantially horizontal position when the contents of the pan have been discharged; and valve means associated with liquid level detector means which is further associated with the pan and arranged and adapted to restore a predeterminable water level in the pan after it has tipped and returned to the substantially horizontal position.

Further according to the invention the 'seat' comprises a squat platform adapted and arranged to overlie a pit dug into the ground.

Also according to the invention the chute comprises a plastics material frustro-conical member adapted to mate with the lower surface of a lavatory seat arrangement and to extend downwardly therefrom into a pit dug into the ground and the tippable pan is formed from a plastics material into the general shape of a scoop adapted to fit loosely around the lower rim of the chute when in the normal or substantially horizontal position and to overlap the rim to a pre-determined degree.

In one form of the invention the tippable pan is pivotally mounted upon a pair of bearing members extending substantially laterally from the outer sides of the chute to mate with a pair of holes in the upper edge of the pan; and wherein the scoop-like shape of the tippable pan creates an inherently unstable configuration about the bearing axes.

The tippable pan may be provided with a counterbalance weight of pre-determinable mass fast with the more rounded or shorter limb of the pan when viewed relative to the bearing axis the counterbalance weight being arranged and adapted to exert a degree of control to the inherently unstable configuration of the tippable pan when matter is added to the interior of the pan.

In a form of the invention the valve means comprises a substantially vertically disposed needle assembly held in a cylindrical guide and seat arrangement the lower end of the needle being associated with a float adapted to sense the level of water in the tippable pan and to regulate the flow of water through the needle and seat by pressure exerted upon the lower zone of the needle and to drive the needle upwardly into engagement with the seat when the water level reaches a pre-determinable level in the tippable pan. In an alternative form of valve for use with the invention, the common plunger and rod-type valve commonly referred to as a 'ball cock assembly' such as used in a lavatory cistern may be employed.

In order to illustrate the nature of the invention and how best it may be put into operation, an example will be described in detail below with reference to the drawings in which:

FIG. 1 is a schematic side elevation of a complete squat-type latrine;

FIG. 2 is a schematic plan view of the squat-type latrine of FIG. 1;

FIG. 3 is a detail section end view of a pan hinge assembly;

FIG. 4 is an exploded view of a preferred hinge assembly;

FIG. 5 is a schematic sectional view of one form of a suitable valve and liquid level detector arrangement;

Referring to the drawings numeral 5 indicates a chute associated with a 'seat' 6 which is adapted to cover a pit-type latrine (not shown).

The lower zone 7 of chute 5 is adapted to lie within a tippable pan 8 which is pivotally mounted about bushes 9 and 10 and pins 11 and 12 which engage with and are held in bosses 13 and 14 fast with the side of chute 5.

In FIG. 2 pins 11 and 12 are illustrated as part of a rod 15 which passes through the body of chute 5 whilst in FIGS. 3 and 4 the pins 11 and 12 are pressed fit into bosses 13 and 14 in the side of chute 5 and are separate entities.

Pan 8 is provided with reinforced appertures 16 and 17 (FIGS. 3 and 4) adapted to mate with bushes 9 and 10 as a pressed fit so as to provide the pivot points about which tippable pan 8 rotates.

Reinforced appertures 16 and 17 are located off centre relative to the longitudinal axis of pan 8 so as to create an inherent instability and tendency to tip. A counterweight 18 is attached to the shorter or rounded limb of pan 8 to counteract the tendency to a pre-determinable degree.

Water level 19 in pan 8 is regulated by valve mechanism 20 which comprises a cylindrical casing 21 adapted to contain a spherical float 22 which will rise with rising water level 19 in the casing 21 and thrust against needle 23 until formation 24 on needle 23 thrusts into seat 25 within casing 21 and seals off inflow of water entering valve 20 through channel 26 and filter 27 from conduit 30.

A retaining grid or bar 28 serves to prevent float 22 from leaving casing 21 when water level 19 falls away due to the pan 8 tipping its contents. An air escape duct 29 is provided in casing 21 to equalise pressure in the casing 21 as water level 19 is again established after pan 8 has tipped and returned to the normal or horizontal position.

In use, a complete unit such as illustrated in FIGS. 1 and 2 is installed over a pit dug into the ground and may be bolted to suitable formation in a concrete ring around the top end of the pit if the latrine is to be a fairly permanent fixture.

A supply line for water from a reservoir (not shown), couples to conduit 30 which in turn leads to the upper end of valve mechanism 20.

As soon as water is placed in the reservoir, the water will enter the valve mechanism 20 and reach pan 8 to establish a water level 19 as illustrated in FIGS. 1, 3 and 5. As will be observed, water level 19 lies above the lower rim 7 of chute 5 thereby providing an effective seal against odours and ingress of insects to the pit.

Should additional material now be added to the interior of pan 8 to an extent sufficient to overcome the mass of counterweight 18, pan 8 will tip about pins 11 and 12 to take up the position illustrated in ghost outline in FIG. 1. This will permit the contents of pan 8 to be discharged into the pit whereupon counterbalance 18 will again exert its controlling influence and tend to return pan 8 to the normal or horizontal position whereupon the water flowing through conduit 30 and valve mechanism 20 re-establishes water 19 in the pan 8.

It will be apparent to those skilled in the art that such details as the hinge mechanism here illustrated can be altered to suit specific circumstances or individual requirements of a particular manufacturer or user, as also can the details of valve mechanism 20 be changed to suit particular circumstances.

The illustrations show only simple, effective and proven methods of hinging and providing for constant water level but are not limiting of the inventive concept which is an efficient, effective, cheap and mechanically sound method and device for the sealing of a latrine or lavatory against escape of odours or ingress of harmful insects.

I claim:

1. A non-flushing device adapted to seal a lavatory arrangement from escape of odors, and ingress of insects, comprising a 'seat' defining an inlet opening, a chute positioned below the 'seat' and defining a passageway which is directed substantially downwardly from said inlet opening and terminates at its lower end in an outlet opening, and a tippable pan mounted at the lower end of the chute and arranged to tip downwardly from a normal or substantially horizontal position towards a substantially vertical discharge position, the pan having a rim which surrounds the lower end of the chute above the outlet opening when the pan is in its normal position yet permits the contents of the pan to discharge downwardly from the pan when the pan tips towards its discharge position, and the device also comprising valve means for admitting water to the pan, and level-sensitive means which act on the valve means to discontinue admission of water to the pan when the level of water in the pan reaches a preselected level above said outlet opening, the pan being arranged and adapted to remain in its normal position when it contains water up to said preselected level but to tip towards its discharge position upon addition of further material to the pan.

2. A device as claimed in claim 1 wherein the 'seat' is a squat platform arranged and adapted to overlie a pit dug into the ground.

3. A device as claimed in claim 1 wherein the chute comprises a plastics material frustro-conical member adapted to mate with the lower surface of a lavatory seat arrangement and to extend downwardly therefrom into a pit dug into the ground and the tippable pan is formed from a plastics material into the general shape of a scoop adapted to fit loosely around the lower rim of the chute when in the normal or substantially horizontal position and to overlap the rim.

4. A device as claimed in any one of claim 1 wherein the tippable pan is pivotally mounted upon a pair of bearing members extending substantially laterally from the outer sides of the chute to mate with a pair of holes in the upper edge of the pan; and wherein the scoop-like shape of the tippable pan creates an inherently unstable configuration about the bearings.

5. A device as claimed in any one of claim 1 wherein the tippable pan is provided with a counterbalance weight fast with the more rounded or shorter limb of the pan when viewed relative to the bearing axes; the counterbalance weight being arranged and adapted to exert a degree control to the inherently unstable configuration of the tippable pan when water is added to the interior of the pan.

6. A device as claimed in any one of claim 1 wherein the valve means comprises a substantially vertically disposed needle assembly held in a cylindrical guide and seat arrangement the lower end of the needle being associated with a float adapted to sense the level of water in the tippable pan and to regulate the flow of water through the needle and seat by pressure exerted upon the lower zone of the needle and to drive the needle upwardly into engagement with the seat when the water level reaches a pre-determinable level in the tippable pan.

* * * * *